US007409730B2

(12) United States Patent
Boos

(10) Patent No.: US 7,409,730 B2
(45) Date of Patent: Aug. 12, 2008

(54) METHOD AND APPARATUS FOR KEEPING A SHIRT COLLAR ALIGNED AND FASTENED, MAGNETICALLY

(76) Inventor: Jonathan B. Boos, 5525 Burnt Branch Cr., Sarasota, FL (US) 34232

( * ) Notice: Subject to any disclaimer, the term of this patent is extended or adjusted under 35 U.S.C. 154(b) by 0 days.

(21) Appl. No.: 11/393,126

(22) Filed: Mar. 30, 2006

(65) Prior Publication Data

US 2006/0218695 A1 Oct. 5, 2006

Related U.S. Application Data

(60) Provisional application No. 60/594,367, filed on Mar. 31, 2005.

(51) Int. Cl.
*A41B 3/00* (2006.01)

(52) U.S. Cl. ..... 2/132

(58) Field of Classification Search ..... 2/131–139, 2/255–260, 260.1, 261, 262, 144, 145, 156, 2/130, 155; 24/66.1, 658, 688, 303
See application file for complete search history.

(56) References Cited

U.S. PATENT DOCUMENTS

| | | | | |
|---|---|---|---|---|
| 2,397,931 | A | 4/1946 | Ellis | |
| 2,964,756 | A | 12/1960 | Liebowitz | |
| 3,086,268 | A | 4/1963 | Chaffin, Jr. | |
| 3,161,932 | A | 12/1964 | Russell | |
| 3,509,734 | A | 5/1970 | Lederer | |
| 3,686,692 | A | 8/1972 | Snare et al. | |
| 4,118,803 | A | 10/1978 | Blau | |
| 4,286,337 | A * | 9/1981 | Malouf, Jr. | 2/116 |
| 4,434,512 | A | 3/1984 | Hansen | |
| 4,653,119 | A | 3/1987 | Kaiser | |
| 4,922,553 | A | 5/1990 | Morrone | |
| 4,959,890 | A | 10/1990 | Pazurek | |
| 5,732,451 | A | 3/1998 | Mars | |
| 5,740,557 | A | 4/1998 | Reid | |
| 5,974,634 | A | 11/1999 | Eisenpresser | |
| 6,089,422 | A | 7/2000 | Gibson | |
| 6,167,732 | B1 | 1/2001 | Friedman | |
| 6,170,131 | B1 | 1/2001 | Shin | |
| 6,226,842 | B1 | 5/2001 | Wong | |
| 6,434,801 | B2 | 8/2002 | Grunberger | |
| 6,748,602 | B1 * | 6/2004 | Barnes | 2/132 |

* cited by examiner

*Primary Examiner*—Tejash Patel
(74) *Attorney, Agent, or Firm*—Haverstock, Garrett & Roberts LLP

(57) ABSTRACT

A method and apparatus for holding a shirt collar in a desired position and orientation, magnetically, against a shirt front. The apparatus includes a collar stay insertable into a conventional collar stay pocket or attachable to an inside surface of a collar, and a magnet magnetically attachable or couplable to the collar stay through the shirt front, and the pocket, if applicable, for holding the shirt collar in the selected position and orientation. The collar stay and the magnet can be optionally interlockable and/or include detents for preventing undesired relative movements thereof, which can include particularly, relative longitudinal movements, but which can also include twisting and sideward movements. For collars which do not include any collar stay pocket, or where a collar stay pocket is not desired to be used, the collar stay can include an adhesive on an outer surface thereof adapted for adhesive attachment to the inside surface of a collar.

37 Claims, 5 Drawing Sheets

METHOD AND APPARATUS FOR KEEPING A SHIRT COLLAR ALIGNED AND FASTENED, MAGNETICALLY

This application claims the benefit of U.S. Provisional Application No. 60/594,367, filed Mar. 31, 2005.

TECHNICAL FIELD

This invention relates to a method and apparatus for keeping a shirt collar properly aligned and fastened, magnetically.

BACKGROUND OF THE INVENTION

The inability to keep a shirt collar properly aligned and fastened, has been an ongoing problem. Solutions to this problem involving magnetic devices, have been attempted. Reference in this regard, Barnes U.S. Pat. No. 6,748,602 entitled Decorative Magnetic Collar Stay, which utilizes a decorative, detachable/attachable outwardly visible magnetic top collar stay portion, and a concealed collar bottom stay portion. The top piece contains two magnets arranged to be attracted to magnets of the bottom piece, such that when the top piece is set on top of a collar with the bottom piece positioned directly underneath the collar, the top and bottom pieces are locked together via the magnetic attraction. The top piece provides a bridge for placement of a customized logo, which can be affixed thereto by a pin. A shortcoming, however, of the Barnes collar stay, is that it is always visible, which may not be desired. Another shortcoming is that multiple magnets are required for holding each collar, which makes the device hefty as well as weighty. Still further, no provision is disclosed for attachment of a collar to a shirt front. This can be a shortcoming where it is desired for the collar of a shirt to be positioned at a certain location on and in relation to the front of a shirt, and/or a certain orientation, for achieving a particular look.

Other devices utilizing magnetics are also known. Reference in this regard, Ellis U.S. Pat. No. 2,397,931, which discloses a magnetic button including two associated parts having the general appearance of an ordinary button, which are magnetic and oppositely attached to flaps of a garment to hold the flaps together. However, the parts are both simple disc shaped members, and there is no disclosure of a capability thereof for retaining the shape and/or alignment of a shirt collar.

Thus, what is sought is a method and apparatus adapted for keeping a shirt collar in a particular desired alignment with a shirt front or other reference, and fastened to the shirt front, and which overcomes one or more of the shortcomings and limitations discussed above.

SUMMARY OF THE INVENTION

What is disclosed is a method and apparatus for keeping a shirt collar aligned and fastened, magnetically, which overcomes one or more of the shortcomings and limitations discussed above.

According to a preferred aspect of the invention, an elongate collar stay, preferably of a thin, flat sheet or film material, such as a magnetic stainless steel material is provided. The collar stay preferably has an elongate conventional overall collar stay shape, including a tapered longitudinal end portion adapted for insertion into a conventional collar stay pocket on the inside surface of a shirt collar, and a rounded opposite end portion. The collar stay can be, for instance, from about 2 to about 3 inches in length, or from about 4 to about 8 centimeters (cm). A suitable range for width is from about 0.6 to about 1.0 cm. As to thickness, a suitable value would be from about 4 to about 8 millimeters (mm). The collar stay can be substantially rigid and flat, or bendable using light finger pressure, to a desired shape. Alternatively, and more preferably, the collar stay has at least one detent or protrusion oriented to face toward a shirt front when the collar is positioned thereover, and operable for retaining a magnet in a desired position and orientation in relation to the stay. A suitable protrusion height from the surface of the stay is from about 1 to about 4 mm. The invention also includes a magnet, which can be, for instance, but is not limited to, a neodymium magnet, which is positioned against the inside surface of the front of a shirt, opposite the collar, and has sufficiently magnetic power for magnetically attracting and attaching or coupling to and holding the stay in a desired position and orientation in relation to the magnet, and thus to the front of the shirt, through at least one layer of fabric, for holding the collar in a desired position and orientation. The magnet can have a disk shape, or alternatively, another shape which cooperates and/or interlocks with the at least one detent or protrusion on the stay, or with one or more edges of the stay, to hold the stay, and thus the collar, in the desired position and orientation, in opposition to normal forces that are anticipated to be exerted thereagainst, for instance as a person wearing the shirt turns his or her neck, or reaches for something. The magnet is preferably of a sufficiently small size so as to be concealable under the collar, yet still provide adequate magnetic force, and interlock with the stay, if desired.

According to another preferred aspect of the invention, the collar stay can be attached to the inner surface of a collar using any convenient manner of attachment, including, but not limited to, by use of an adhesive. For instance, an adhesive strip can be attached to the surface of the stay, and removed and replaced, as necessary when the adhesive is no longer functional. A spray on, dab on, or other adhesive can also be used. Still further, as another preferred aspect of the invention, the collar stay can be sewn in place between the inner and outer layers of the collar. In this latter regard, this is preferably done in a manner such that the stay is not visible from the outer side of the collar. Also, it is contemplated that the collar stay can include the at least one detent or protrusion at several locations along the length thereof, such that the portion of the stay to which the magnet is to be attached is selectable from some desired number of positions.

According to still another preferred aspect of the invention, the following steps are used with shirts featuring a collar stay pocket:

1. Slide the stainless steel collar stay into the collar stay pocket of a collar;
2. Position the magnetic disk inside of the front of the shirt; and attach or connect the collar stay and the magnetic disk using the magnetic attraction properties of the disk; and
3. Repeat steps 1 and 2 on the other collar.

According to still another preferred aspect of the invention, the following steps are used with shirts without a collar stay pocket:

1. Peel the film off of the adhesive side of the collar stay. Position the collar stay in the desired position on the inside surface of the collar, and press firmly;
2. Position the magnetic disk inside of the front of the shirt; and attach or connect the collar stay and the magnetic disk using the magnetic attraction properties of the disk; and
3. Repeat steps 1 and 2 on the other collar.

DETAILED DESCRIPTION OF THE PREFERRED EMBODIMENTS

Figure 1:
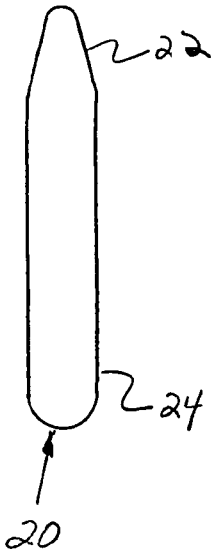
FIG. 1 is a side view of a collar stay of the invention.

Referring now to the drawings, wherein like numerals refer to like parts, FIGS. 1, 2, 3, 4, and 5 illustrate various elements of apparatus of the invention, required for practice of methods of the invention. More particularly, FIG. 1 illustrates a collar stay 20 of the invention, which is preferably of sheet metal construction composed of a magnetic stainless steel material, such as, but not limited to, a 400 series stainless steel, such as a 404 or 416 series. Stay 20 has an elongated shape including a tapered and portion 22 and an opposite rounded end portion 24. Stay 20 is preferably from about 2 to about 4 inches in length, or of the other dimensions set forth above, so as to be insertable into a conventionally dimensioned and constructed collar stay pocket on the inner surface of a shirt collar, such as illustrated by pocket region A in FIG. 4, but can alternatively be of another suitable length and/or shape as desired or required for a particular application.

Figure 2:
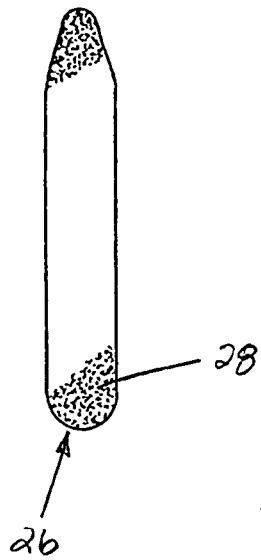
FIG. 2 is a side view of another collar stay of the invention.

FIG. 2 illustrates another collar stay 26 of the invention, constructed of the same material as collar stay 20, and of about the same dimensions, but having one surface including a layer of adhesive 28 thereon, which can be an adhesive film, coating, or layer, or an adhesive tape, having a side which faces outwardly from stay 26, for adhesion to an inner surface of a shirt collar, as will be explained. Collar stay 26 is contemplated for use with a shirt collar which lacks a collar stay pocket, or for use where a collar stay pocket is present but not desired to be used.

Figure 3:
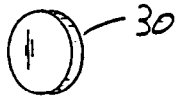
FIG. 3 is a perspective view of a magnet of the invention.

FIG. 3 illustrates a magnet 30 of the invention, which can be constructed of a suitable commercially available magnetic material, such as, but not limited to, a neodymium magnetic material, suitable for magnetically attaching to and holding a collar stay such as stay 20 or stay 26 through one or several layers of a typical shirt fabric, such as a cotton, wool, synthetic material, or blend of any of these, in a desired position and orientation.

Figure 4:
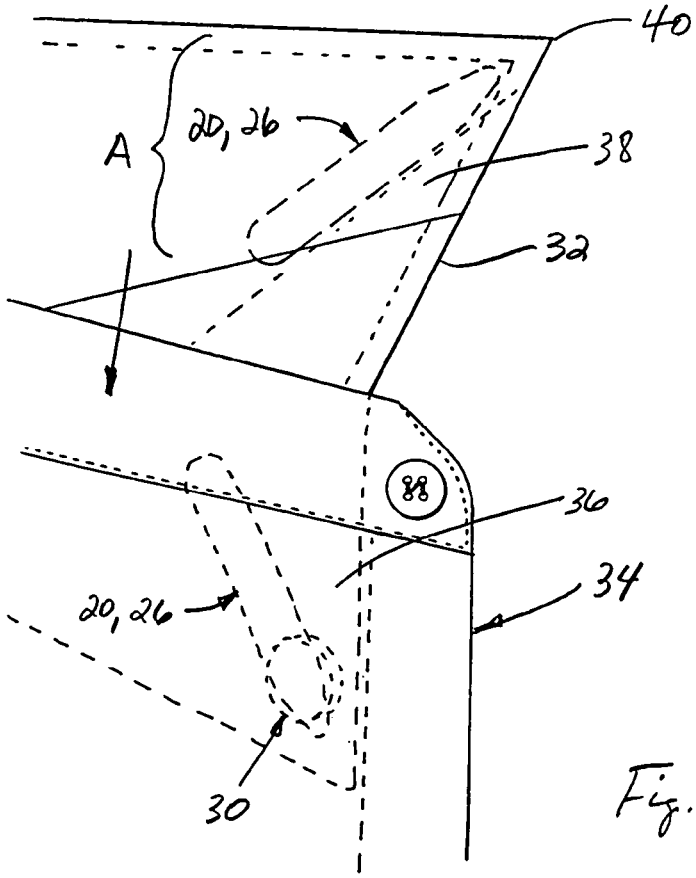
FIG. 4 is a front view of a shirt, showing a collar stay of the invention in connection with a collar of the shirt, and in dotted lines, the collar folded down and held in desired position and alignment by a magnet of the invention.
Figure 5:
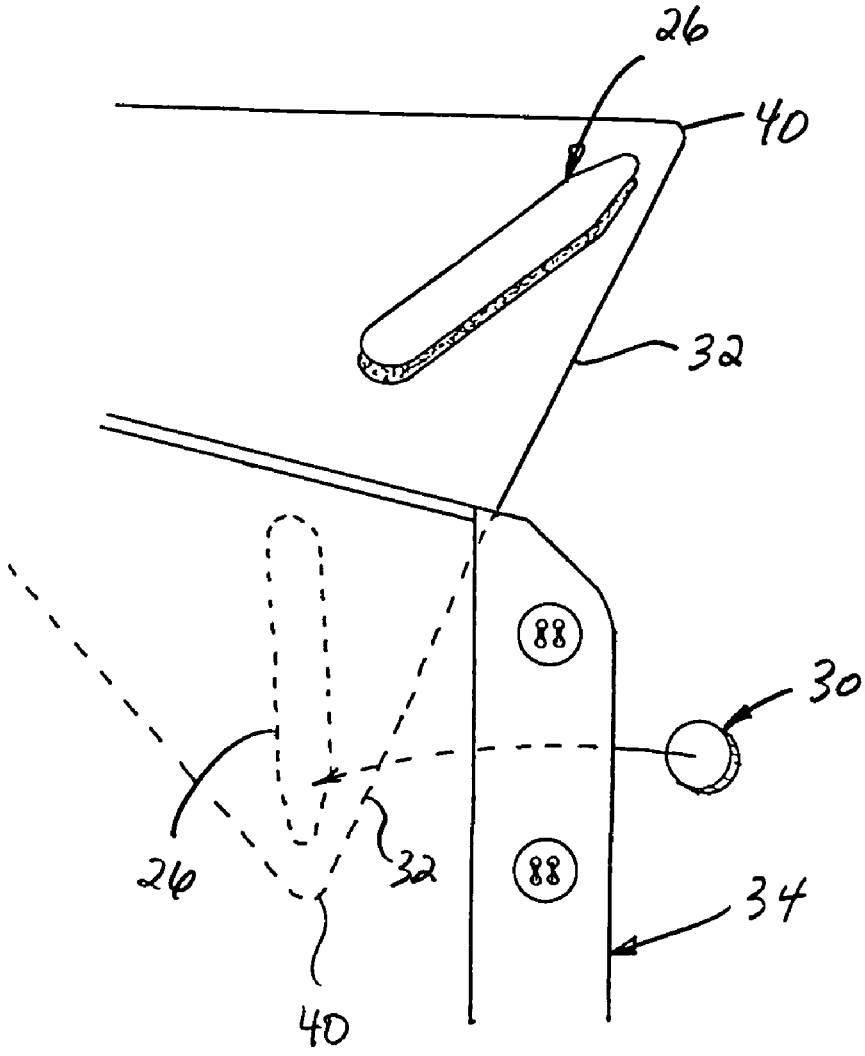
FIG. 5 is a front view of a shirt, showing a collar stay of the invention adhesively attached to an inner surface of a shirt collar, and in dotted lines, the collar folded down, and illustrating insertion of a magnet into the shirt behind the front surface thereof for magnetically holding the collar stay and the collar in a desired position and alignment in relation to the shirt front.

FIGS. 4 and 5 illustrate aspects of steps of methods of the invention for using a collar stay 20 or 26 and a magnet 30 with a collar 32 of a shirt 34, for holding the collar 32 in a desired position and orientation in relation to a front 36 of shirt 34. Essentially, collar stay 20 is slid into a collar stay pocket, such as pocket A (FIG. 4), on an inner or inside surface 38 of collar 32, or, collar stay 26 is adhered to the inside surface 38 (FIG. 5), in a desired position and orientation, such as, but not limited to, pointing toward a point 40 of collar 32 at a desired angular orientation in relation thereto, as illustrated. Magnet 30 is then positioned beneath or inside of front 36 of shirt 34 at a desired position for connection to stay 20 or 26 by magnetic attraction, as illustrated in dotted lines. These steps are then repeated for the other collar of the shirt. Here, it should be noted that neither collar stay 20 or collar stay 26 will typically be visible from the outer surface of collar 32, and magnet 30 will be concealed behind front 36 of the shirt, such that neither elements of the invention are evident. Yet, the magnetic attraction between magnet 30 and stay 20 or 26 will be sufficient to hold the collar, particularly point 40 thereof, in the desired position and orientation in relation to the shirt front.

Figure 6:
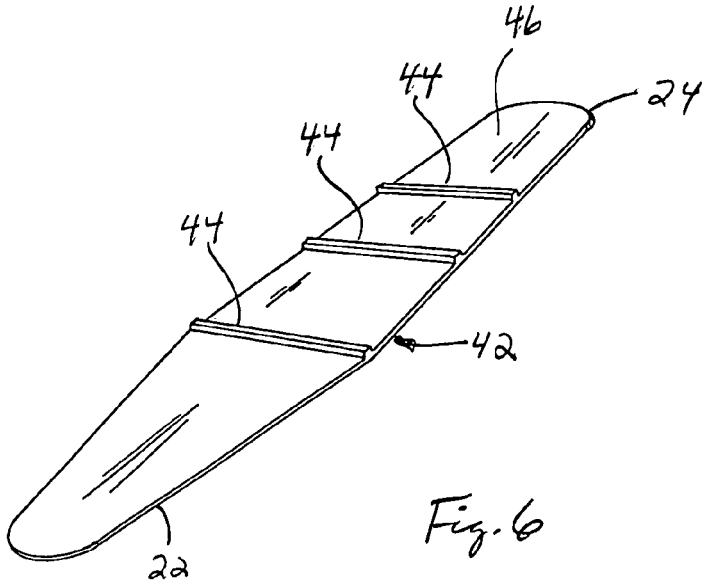
FIG. 6 is a perspective view of another collar stay of the invention.
Figure 7:
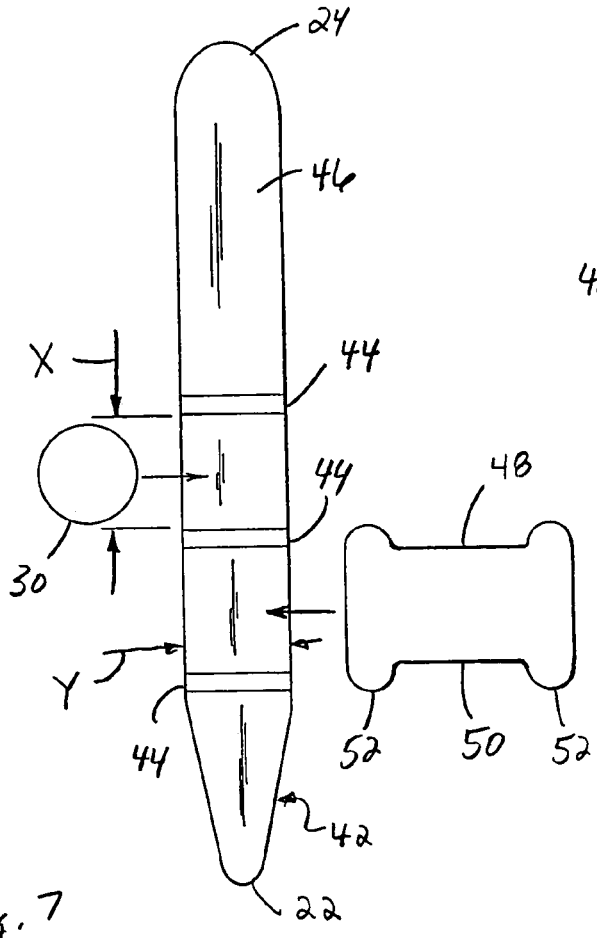
FIG. 7 is a side view of the collar stay of FIG. 6, illustrating alternative magnet constructions usable therewith in accordance with the invention.
Figure 8:
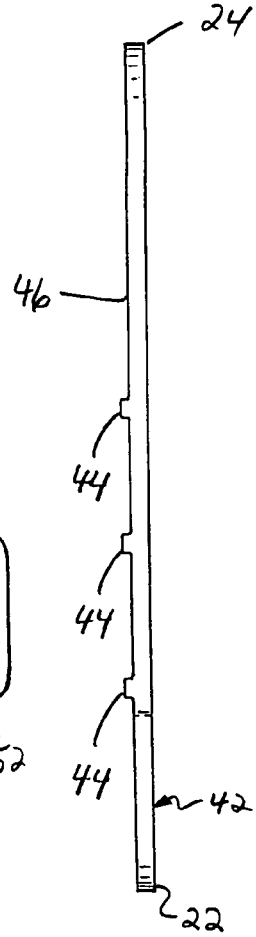
FIG. 8 is an edge view of the collar stay of FIG. 6.

FIGS. 6, 7 and 8 illustrate another collar stay 42 of the invention, like parts of stay 42 and stays 20 and 26 being identified by like numerals. Stay 42 is likewise preferably constructed of a magnetic stainless steel material such as a 400 series stainless steel and has an elongated shape including a tapered end portion 22 and a rounded end portion 24. An additional feature of stay 42, however, is at least one, and more preferably several, detents 44 protruding from an inside surface 46 of stay 42, at predetermined locations spaced from tapered end portion 22. Each detent 42 can have a shape or configuration suitable for preventing or substantially limiting movement of a magnet in close proximity and magnetically attached to surface 46, such as magnet 30, longitudinally along the surface 46, even when 1, 2 or 3 layers of shirt fabric are disposed therebetween. The detent 42 closest to end portion 22 is preferably disposed a distance X from end portion 22, and adjacent ones of detents 42 are preferably about the distance X apart, distance X preferably being equal to an amount just marginally larger than the cross-sectional extent of a magnet, such as magnet 30, to be used therewith, such that the magnet can be disposed between two of the detents 42 and held longitudinally in place. Here, although three detents 42 are illustrated, it should be understood that a greater, or a lesser, number of detents could be used. In FIG. 7, it should also be noted that an alternative magnet 48 is shown having a generally "dog bone" shape having a narrowed intermediate portion 50 disposed between opposite and portions 52, intermediate portion 50 as measured between opposite and portions 52 having an extent preferably just marginally larger than a sideward extent Y of stay 42, such that when magnetically attached, both sideward and longitudinal relative movement of magnet 48 and stay 42, and thus a collar such as collar 34, will be prevented or substantially limited.

Figure 9:
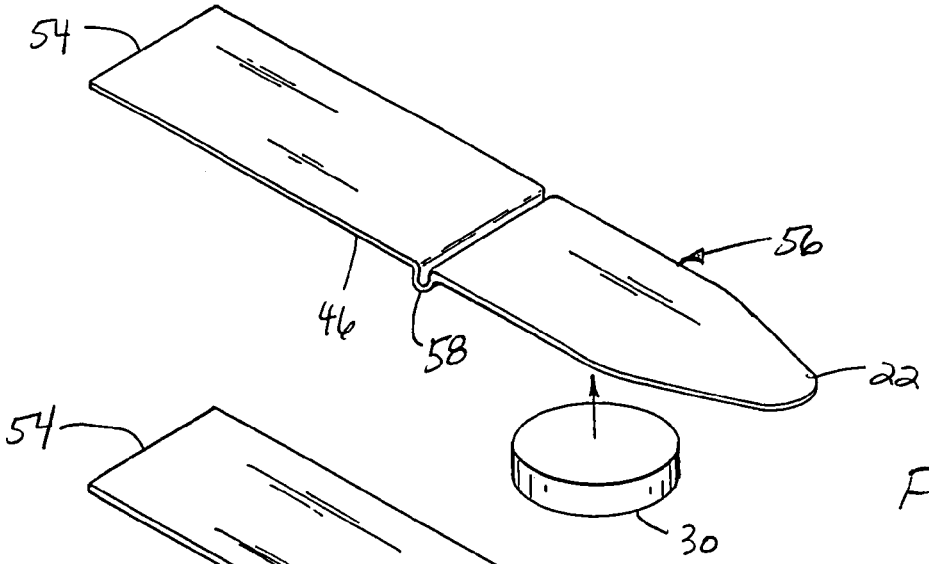
FIG. 9 is a perspective view of another collar stay of the invention, and a magnet.
Figure 10:
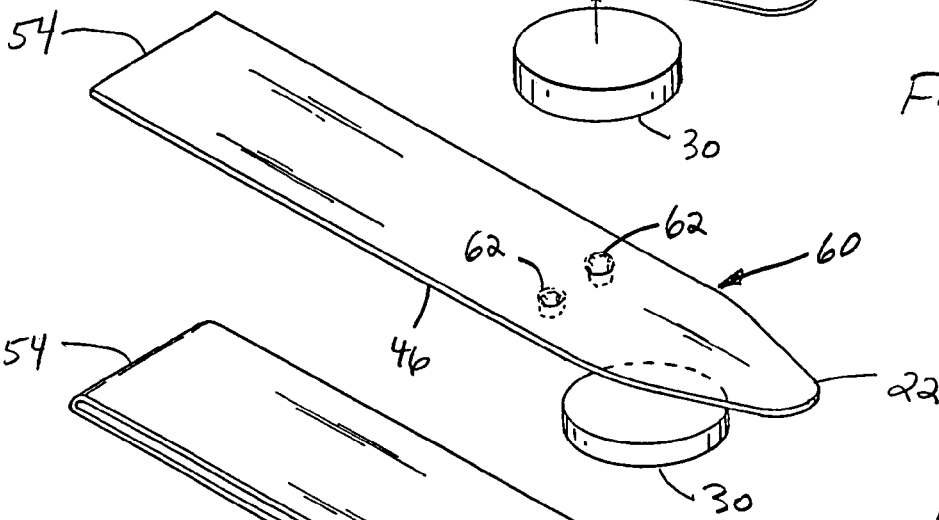
FIG. 10 is a perspective view of another collar stay of the invention, and a magnet.
Figure 11:
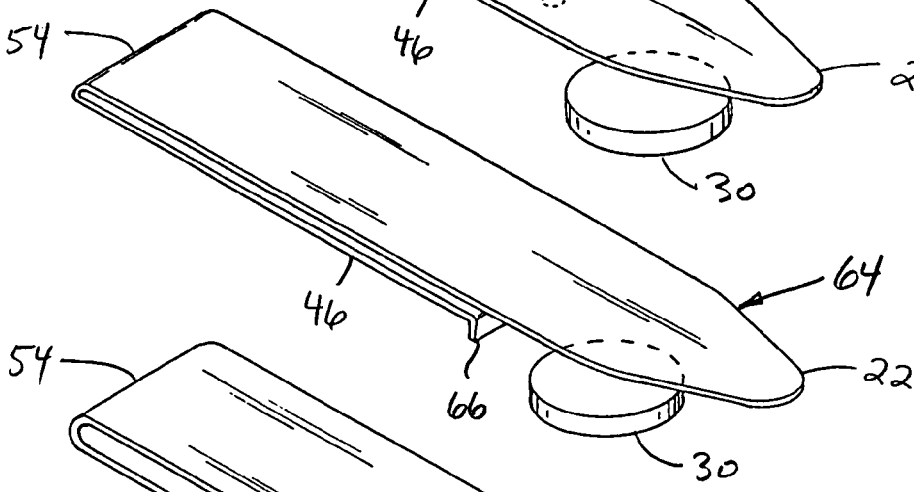
FIG. 11 is a perspective view of still another collar stay of the invention, and a magnet.
Figure 12:
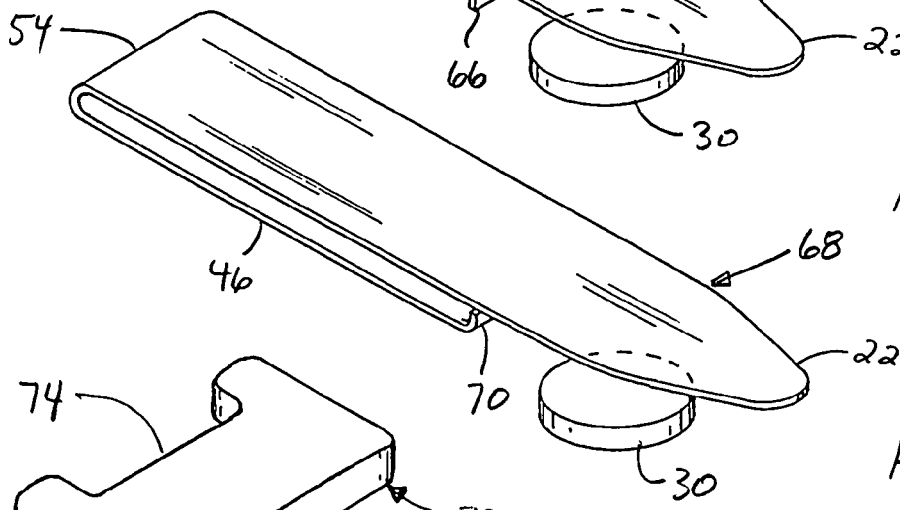
FIG. 12 is a perspective view of yet another collar stay of the invention, and a magnet.

FIGS. 9, 10, 11 and 12 illustrate still further alternative embodiments of collar stays of the invention, like parts of the collar stays of these FIGS. and those of the earlier FIGS. being identified by like numerals. Each of the collar stays of FIGS. 9, 10, 11 and 12 can be constructed of the above described magnetic stainless steel material, and can have a similar overall size and shape as discussed above, generally including a tapered end portion 22 and an opposite rounded end portion 24 (see above), or a more squared and portion 54, as desired. In FIG. 9, a collar stay 56 is shown, including a detent 58 on an inside surface 46 thereof, which will face a shirt front, for preventing or limiting longitudinal movement of a magnet magnetically attached thereto, as illustrated generally by magnet 30. Detent 58 can be formed in any suitable manner, such as by folding or creasing stay 56. Here, it should again be noted that one or more of detents 58 could be used, as desired or required for a particular application. In FIG. 10, a collar stay 60 includes a pair of detents 62 protruding from surface 46, similarly positioned for the same purpose for preventing longitudinal movement of a magnet therealong. Here, detents 62 are spaced sidewardly apart sufficiently to also serve to center a magnet, such as magnet 30, in relation to the side edges of collar stay 60. Again, one or more pair of detents 62 can be used at desired longitudinal positions on surface 46, as desired or required for a particular application. Detents 62 can comprise raised portions or protrusions from surface 46, formed using a suitable metalworking technique, such as peening, stamping, or the like. Detents 62 could also be formed by welding, or adhesion of separate members onto surface 46. In FIG. 11, another collar stay 64 it is illustrated which is of a folded sheet metal construction so as to include a raised detent 66 protruding from surface 46. This construction can also be made by a suitable metalworking technique. Detent 66 will function in the above described manner for preventing longitudinal movement of a magnet, such as magnet 30, along the collar stay 64. And, in FIG. 12, collar stay 68 is also of a folded sheet metal construction to include a detent 70 on an edge of inside surface 46 adjacent to a magnet, such as magnet 30, for preventing longitudinal movement of the magnet.

Here, it should be understood that any of collar stays 56, 60, 64 or 68 can include an adhesive on an outside surface thereof, such as illustrated in FIG. 2, or can be smooth so as to be readily insertable into a collar stay pocket, as illustrated in FIG. 4. Additionally, collar stays 64 and 68 can be inserted into a collar stay pocket with the portion thereof including surface 46 located externally thereof, and surface 46 can be resiliently biased toward the body of the stay, similarly to a hairpin, for clipping about the pocket for better retention of the stay in the pocket.

Figure 13:
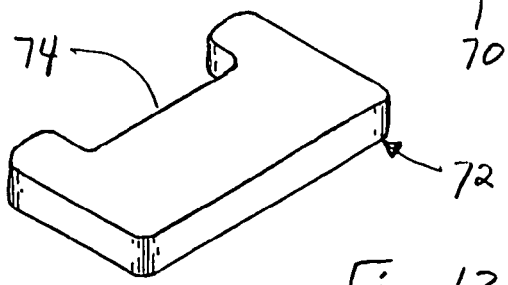
FIG. 13 is a perspective view of an alternative magnet construction of the invention.

FIG. 13 illustrates still another alternative magnet 72 that can be used with the present invention, magnet 72 having a side pocket 74 adapted for cooperatively receiving a detent, such as any of detents 44, 58, 62, 66 and 70, for interlocking therewith for preventing relative longitudinal movement between magnet 72 and the respective collar stay, as well as side to side and twisting movements.

Figure 14:
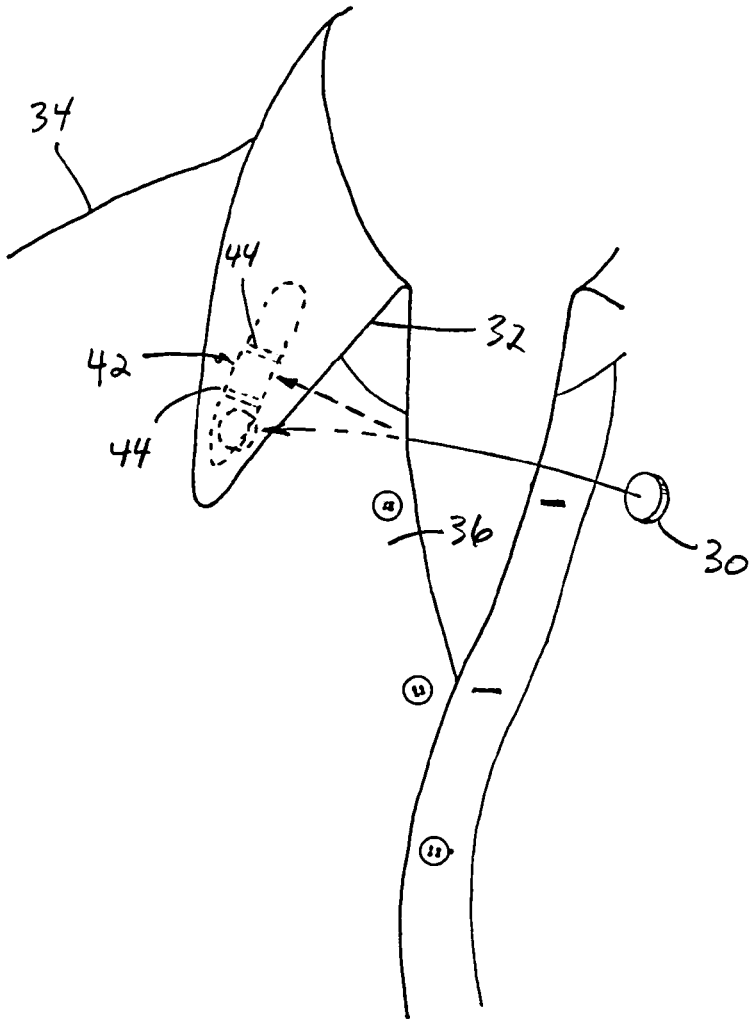
FIG. 14 is a front view of a shirt having a collar stay of the invention installed on a collar of the shirt, and illustrating use of a magnet in connection with various locations along the collar stay.

Referring also to FIG. 14, a collar stay 42 is shown in position retained on the inside surface of a collar 32, for instance, within a collar stay pocket A (FIG. 4) or adhered thereto (FIG. 5), and a magnet 30 selectively detachable thereto through a front 36 of a shirt 34, at several locations along the length of stay 42, as defined by detents 44. This illustrates the versatility of the present invention for effecting attachment of a collar 32 to a shirt front 36 in several different ways, for achieving different appearances or looks.

Figure 15:
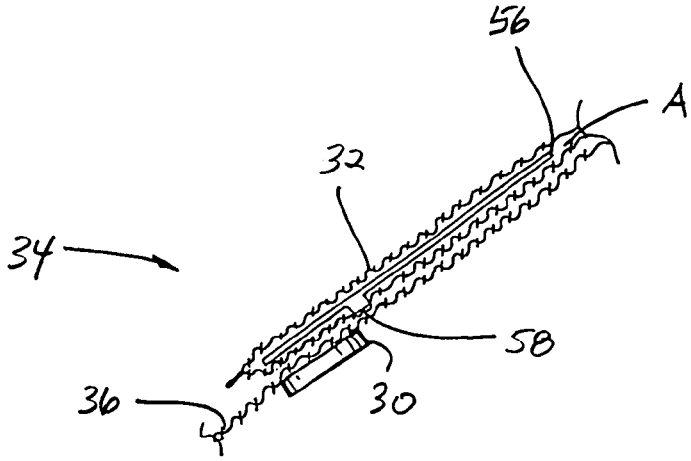
FIG. 15 is a sectional view through a shirt front and collar having a collar stay of the invention located in a pocket of the collar, and illustrating a magnet in connection therewith.

Referring also to FIG. 15, a collar 32 of a shirt 34 is shown held in place against a front 36 of the shirt by a collar stay 56 and a magnet 30 of the invention. Here, detent 58 of stay 56 is illustrated to retain and hold magnet 30 adjacent to the end of stay 56.

As should be apparent from the disclosure above, the various embodiments of collar stays and magnets of the invention can be used in combination to achieve a desired retention and positioning of a collar in relation to a shirt front, including the angular orientation of the collar in relation thereto, without the apparatus used for the same being visible or apparent to persons observing the shirt. The various collar stays can optionally be bendable to some extent by hand, to achieve a desired look, for instance, for fashion purposes. Thus, for example, a collar could be positioned and retained by the present apparatus in a widely spread manner, for a more contemporary look, or less spread, so as to be positioned closer to the neck of a shirt, for a more traditional look.

Thus, there has been shown and described a novel method and apparatus for keeping a shirt collar aligned and fastened, magnetically, which overcomes many of the problems set forth above. It will be apparent, however, to those familiar in the art, that many changes, variations, modifications, and other uses and applications for the subject device are possible. All such changes, variations, modifications, and other uses and applications that do not depart from the spirit and scope of the invention are deemed to be covered by the invention which is limited only by the claims which follow.

What is claimed is:

1. Apparatus for magnetically holding a shirt collar in a position and orientation on a shirt front, comprising in combination:

an elongate collar stay adapted for attachment to an inside surface of a shirt collar or positionable within a collar stay pocket of a collar, the collar stay comprising a material attractable by a magnet; and a magnet positionable against an inside surface of a shirt front opposite a collar thereof and operable for magnetic attachment to the elongate collar stay through the shirt front, for holding a collar to which the collar stay is attached, against the shirt front, wherein the collar stay includes an inside surface oriented for facing the magnet when the stay is attached to an inside surface of a shirt collar, the inside surface of the stay including at least one detent protruding therefrom for substantially limiting relative longitudinal movement between the stay and the magnet when magnetically attached thereto through a shirt front.

2. Apparatus of claim 1, comprising a plurality of the detents positioned at longitudinally spaced locations on the inside surface of the collar stay.

3. Apparatus of claim 1, wherein the detent is configured for preventing relative side to side movement of the collar stay and the magnet when magnetically attached through a shirt front.

4. Apparatus of claim 1, wherein the collar stay and the magnet include cooperatively engageable portions for substantially limiting relative movements thereof when magnetically attached through a shirt front.

5. Apparatus of claim 1, wherein the magnet is dog bone shaped.

6. Apparatus of claim 1, wherein the collar stay includes an inside surface oriented for facing the magnet when the stay is attached to an inside surface of a shirt collar, the inside surface of the collar stay including at least one detent thereon, and the magnet including a pocket therein for cooperatively receiving the detent for holding the collar stay in a predetermined orientation in relation to the magnet when magnetically attached through a shirt front.

7. Apparatus of claim 1, wherein the magnet is a neodymium magnet.

8. Apparatus of claim 1, wherein the magnet is disk shaped.

9. Apparatus of claim 1, wherein the collar stay has an outer surface including an adhesive thereon for adhesive attachment to an inside surface of a shirt collar.

10. Apparatus of claim 1, wherein the at least one detent is formed by folding or creasing the collar stay.

11. Apparatus of claim 1, wherein the collar stay comprises a 400 series stainless steel material.

12. A method for attaching a shirt collar to a shirt front, comprising steps of:

providing an elongate collar stay adapted for attachment to an inside surface of a shirt collar, the collar stay being magnetically attachable to a magnet, wherein the collar stay includes at least one detent protruding from an inside surface thereof and configured for substantially limiting relative longitudinal movement between the collar stay and the magnet when magnetically attached through a shirt front;

providing a magnet positionable against a shirt front opposite a collar; and attaching the collar stay to an inside surface of a shirt collar;

positioning the magnet inside of a shirt against a shirt front thereof opposite the shirt collar to which the collar stay is attached; and bringing the collar stay into proximity with the magnet for magnetically attaching the collar stay to the magnet through the shirt front.

13. The method of claim 12, wherein the collar stay is configured to be insertable into a collar stay pocket on an inside surface of a shirt collar, and comprising the additional step of inserting the collar stay into a collar stay pocket on an inside surface of a shirt collar.

14. The method of claim 12, wherein the collar stay includes an adhesive thereon adapted for attachment to an inside surface of a shirt collar.

15. The method of claim 12, wherein the magnet is a neodymium magnet.

16. The method of claim 12, wherein the collar stay and the magnet are configured to be cooperatively engageable when magnetically attached through a shirt front for substantially limiting at least relative longitudinal movement therebetween.

17. The method of claim 16, wherein the magnet is dog bone shaped.

18. Apparatus for magnetically holding a shirt collar in a position and orientation on a shirt front, comprising in combination:

an elongate collar stay adapted for attachment to an inside surface of a shirt collar or positionable within a collar stay pocket of a collar, the collar stay comprising a material attractable by a magnet; and a magnet positionable against an inside surface of a shirt front opposite a collar thereof and operable for magnetic attachment to the elongate collar stay through the shirt front, for holding a collar to which the collar stay is attached, against the shirt front, wherein the collar stay has an outer surface including an adhesive thereon for adhesive attachment to an inside surface of a shirt collar.

19. Apparatus for magnetically holding a shirt collar in a position and orientation on a shirt front, comprising in combination:

an elongate collar stay adapted for attachment to an inside surface of a shirt collar or positionable within a collar stay pocket of a collar, the collar stay comprising a material attractable by a magnet; and a magnet positionable against an inside surface of a shirt front opposite a collar thereof and operable for magnetic attachment to the elongate collar stay through the shirt front, for holding a collar to which the collar stay is attached, against the shirt front, wherein the collar stay includes at least one detent protruding from an inside surface thereof formed by folding or creasing the collar stay.

20. Apparatus of claim 19, comprising a plurality of the detents positioned at longitudinally spaced locations on the inside surface of the collar stay.

21. Apparatus of claim 19, wherein the detent is configured for preventing relative side to side movement of the collar stay and the magnet when magnetically attached through a shirt front.

22. Apparatus of claim 19, wherein the collar stay and the magnet include cooperatively engageable portions for substantially limiting relative movements thereof when magnetically attached through a shirt front.

23. Apparatus of claim 19, wherein the magnet is dog bone shaped.

24. Apparatus of claim 19, wherein the collar stay includes an inside surface oriented for facing the magnet when the stay is attached to an inside surface of a shirt collar, the inside surface of the collar stay including at least one detent thereon, and the magnet including a pocket therein for cooperatively receiving the detent for holding the collar stay in a predetermined orientation in relation to the magnet when magnetically attached through a shirt front.

25. Apparatus of claim 19, wherein the magnet is a neodymium magnet.

26. Apparatus of claim 19, wherein the collar stay has an outer surface including an adhesive thereon for adhesive attachment to an inside surface of a shirt collar.

27. Apparatus of claim 19, wherein the collar stay comprises a 400 series stainless steel material.

28. Apparatus for magnetically holding a shirt collar in a position and orientation on a shirt front, comprising in combination:

an elongate collar stay adapted for attachment to an inside surface of a shirt collar or positionable within a collar stay pocket of a collar, the collar stay comprising a material attractable by a magnet; and a magnet positionable against an inside surface of a shirt front opposite a collar thereof and operable for magnetic attachment to the elongate collar stay through the shirt front, for holding a collar to which the collar stay is attached, against the shirt front, wherein the collar stay includes an inside surface oriented for facing the magnet when the stay is attached to an inside surface of a shirt collar, the inside surface of the collar stay including at least one detent thereon, for holding the collar stay in a predetermined orientation in relation to the magnet when magnetically attached through a shirt front.

29. Apparatus of claim 28, comprising a plurality of the detents positioned at longitudinally spaced locations on the inside surface of the collar stay.

30. Apparatus of claim 28, wherein the magnet is a neodymium magnet.

31. Apparatus of claim 28, wherein the collar stay has an outer surface including an adhesive thereon for adhesive attachment to an inside surface of a shirt collar.

32. Apparatus of claim 28, wherein the at least one detent is formed by folding or creasing the collar stay.

33. Apparatus of claim 28, wherein the collar stay comprises a 400 series stainless steel material.

34. A method for attaching a shirt collar to a shirt front, comprising steps of:

providing an elongate collar stay adapted for attachment to an inside surface of a shirt collar, the collar stay being magnetically attachable to a magnet, wherein the collar stay includes an adhesive thereon adapted for attachment to an inside surface of a shirt collar;

providing a magnet positionable against a shirt front opposite a collar; and attaching the collar stay to an inside surface of a shirt collar;

positioning the magnet inside of a shirt against a shirt front thereof opposite the shirt collar to which the collar stay is attached; and bringing the collar stay into proximity with the magnet for magnetically attaching the collar stay to the magnet through the shirt front.

35. The method of claim 34, wherein the magnet is a neodymium magnet.

36. The method of claim 34, wherein the collar stay and the magnet are configured to be cooperatively engageable when magnetically attached through a shirt front for substantially limiting at least relative longitudinal movement therebetween.

37. The method of claim 34, wherein the collar stay includes at least one detent protruding from an inside surface thereof and configured for substantially limiting relative longitudinal movement between the collar stay and the magnet when magnetically attached through a shirt front.

* * * * *